United States Patent [19]

Friedrichs

[11] Patent Number: 4,762,465

[45] Date of Patent: Aug. 9, 1988

[54] WATER PUMP IMPELLER

[75] Inventor: K. Gerd Friedrichs, Leverkusen, Fed. Rep. of Germany

[73] Assignee: Klifa-Fahrzeugteile GmbH + Co., Mannheim, Fed. Rep. of Germany

[21] Appl. No.: 33,087

[22] PCT Filed: Jun. 27, 1986

[86] PCT No.: PCT/DE86/00271

§ 371 Date: Feb. 17, 1987

§ 102(e) Date: Feb. 17, 1987

[87] PCT Pub. No.: WO87/00249

PCT Pub. Date: Jan. 15, 1987

[30] Foreign Application Priority Data

Jun. 29, 1985 [DE] Fed. Rep. of Germany ..... 3523419

[51] Int. Cl.[4] ..... F04D 7/02

[52] U.S. Cl. ..... 416/185; 416/188; 416/224; 416/241 A; 415/214; 415/215; 415/DIG. 5

[58] Field of Search ..... 416/241 A, 185, 224, 416/188; 415/214, 215, DIG. 5

[56] References Cited

U.S. PATENT DOCUMENTS

| | | | |
|---|---|---|---|
| 1,525,724 | 2/1925 | Davison | 415/214 |
| 2,120,277 | 6/1938 | Grierson | 415/214 X |
| 2,498,348 | 2/1950 | Thompson | 415/214 X |
| 2,649,052 | 8/1953 | Weyer | 415/214 X |
| 3,155,045 | 11/1964 | Lown et al. | 415/214 X |
| 3,189,671 | 6/1965 | Babb | 416/241 A X |
| 3,408,944 | 11/1968 | Belonger et al. | 416/241 A |
| 3,551,067 | 12/1970 | Wissman | 416/241 A X |
| 3,659,471 | 5/1972 | Marsch | 416/60 X |
| 3,846,045 | 11/1974 | Mincuzzi | 416/241 A X |

FOREIGN PATENT DOCUMENTS

| | | | |
|---|---|---|---|
| 1115585 | 10/1961 | Fed. Rep. of Germany . | |
| 1528765 | 1/1970 | Fed. Rep. of Germany | 416/241 A |
| 2535878 | 2/1977 | Fed. Rep. of Germany | 416/241 A |
| 3307386 | 9/1984 | Fed. Rep. of Germany . | |
| 359036 | 1/1962 | Switzerland | 416/241 A |
| 497287 | 12/1937 | United Kingdom . | |

*Primary Examiner*—Everette A. Powell, Jr.

*Attorney, Agent, or Firm*—Fleit, Jacobson, Cohn & Price

[57] ABSTRACT

The water pump impeller comprises a boss with a disk part shaped thereon and a circular or paraboloid transition region is provided between the boss and the disk part. A metal reinforcing disk is embedded round on either side by injection moulding in the disk part, including the transition region. The reinforcing disk has as a component of the boss, a boss part with which it can be mounted on a drive shaft.

3 Claims, 4 Drawing Sheets

WATER PUMP IMPELLER

Figure 1:
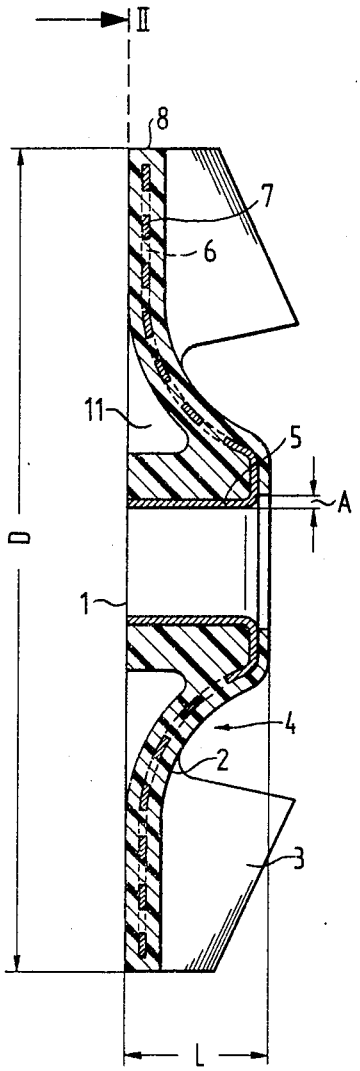

The invention relates to a water pump impeller for a cooling water pump in an internal combustion engine with a metal boss for mounting on a shaft, with a metal reinforcing disk coaxially shaped on to one end of the metal boss and surrounded by plastic, with guide vanes shaped from plastic in the outer circumferential region of the water pump impeller and with plastic parts shaped longitudinally over and beyond the boss.

Water pump impellers are fundamentally known and are used in pumps for transferring cooling water for engine cooling purposes in motor vehicles. Special conditions are made with respect to the materials and the constructional design due to the thermal stresses for this particular use, in which temperatures from approximately −40° to +130° C. can occur. The use of grey cast iron or brass for a water pump impeller leads to the disadvantage that it has a cavitation tendency, i.e. to a destruction of the impeller blades, which leads to pump failure. In addition, there is the disadvantage that the surface is rough, which increases the flow resistance.

Water pumps are also known in which the water pump impeller is made entirely from plastic. However, due to the high heat and cold stresses this construction is not suitable for motor vehicles, because the impellers deflect or sag to such an extent that they run against the casing wall.

Furthermore U.S. Pat. No. 3,251,307 discloses a water pump impeller for use in internal combustion engines, which has a metal boss and a metal reinforcing disk coaxially shaped thereon and oriented substantially at right angles to the boss axis. The reinforcing disk, together with the outer surface of the boss is embedded in a plastic body. Those plastic parts extending over the boss edges in the longitudinal direction of the boss terminate flush with the boss inner face. The plastic body extends radially over and beyond the reinforcing disk and in this outer circumferential region guide vanes are formed in the plastic part.

There is consequently a risk that the area carrying the guide vanes will sag, particularly under thermal stress. It is also unavoidable that as a result of the different expansion coefficients, strains will occur and the plastic will become deformed. It can also not be excluded that at high speeds there will be twisting of the reinforcing disk and water pump impeller, which reduces efficiency.

The problem of the invention is therefore to provide a water pump impeller of the aforementioned type, which is protected against deformation.

This problem is solved in that the reinforcing disk is provided in the vicinity of the guide vanes with an annular disk part and with a revolution paraboloid-like reinforcing region between the boss and the annular disk part running at an acute angle to the boss, that the guide vanes are arranged on the concave side of the reinforcing disk and that the plastic part projecting beyond the boss in the direction of the longitudinal axis terminates at a given distance from the boss inner face to avoid contact with the shaft.

The invention provides the advantage that the water pump impeller is completely reinforced against twisting and is protected against sagging. Thus, the path of the water pump impeller and in particular the guide vanes is maintained in an extremely accurate manner, so that an adjustment is possible in the pump housing with a relatively small tolerance range, so that the pump efficiency can be increased. The reinforcement of the water pump impeller is on the one hand based on the parabola cross-section of the inner circumferential region of the reinforcing disk and on the other hand on the fact that the reinforcing disk is led into the outer circumferential region of the impeller and below the guide vanes. Since, according to the invention, there is also no contact between the plastic and the drive shaft, heating and flowing of the plastic is prevented.

As a result of the inventive arrangement of the guide vanes on the concave side of the reinforcing disk, it is possible to achieve an extremely shallow construction of the water pump impeller.

According to a preferred development of the invention a boss ring is pressed over the boss. This measure leads to a reinforcement of the boss and to the boss ring compensating any material fatigue or weakening occurring after prolonged operation.

It can be advantageous to completely embed the boss ring in the plastic, so that the position of the boss ring on the boss is fixed and detachment is prevented.

According to another advantageous further development of the invention between boss and reinforcing region are shaped radial plastic ribs.

In addition, the water pump impeller is preferably reinforced in that in front of a boss opening is formed a tapering plastic part rotationally symmetrical to the boss axis. The free end of the boss is also preferably widened in trumpet-shaped manner.

The invention is described in greater detail hereinafter relative to embodiments and the drawings, wherein show:

FIG. 1 A cross-section through a first embodiment of a water pump impeller.

Figure 2:
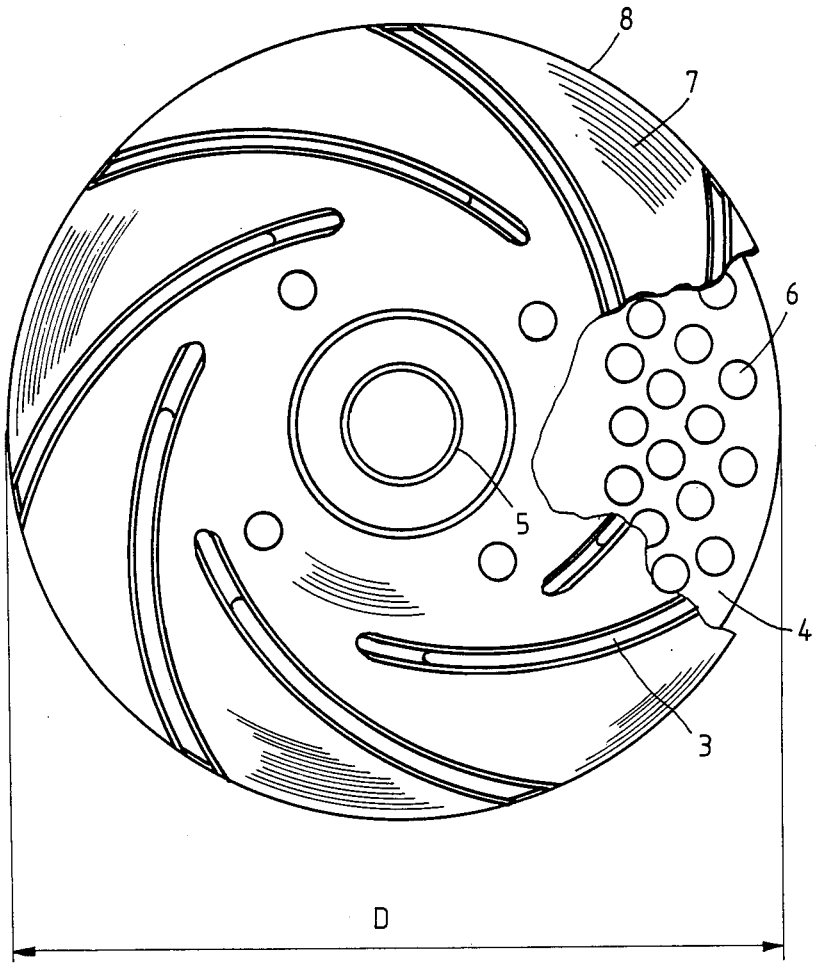

FIG. 2 A plan view of the water pump impeller according to FIG. 1.

Figure 3:
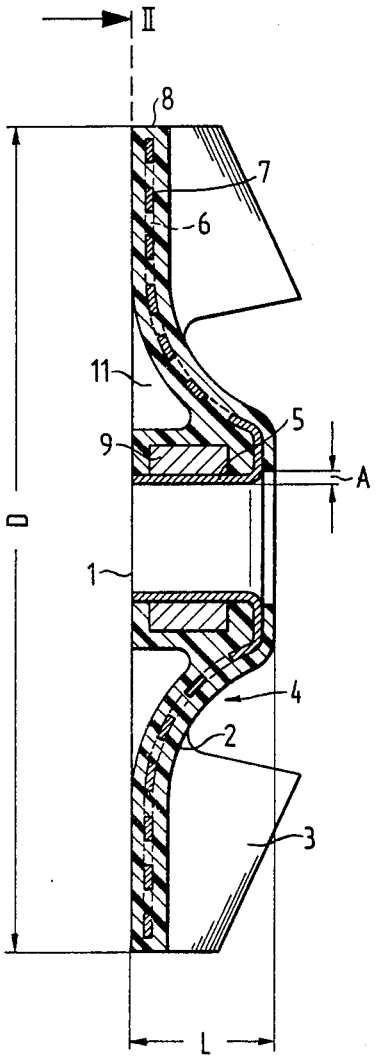

FIG. 3 A cross-section through another embodiment of a water pump impeller.

Figure 4:
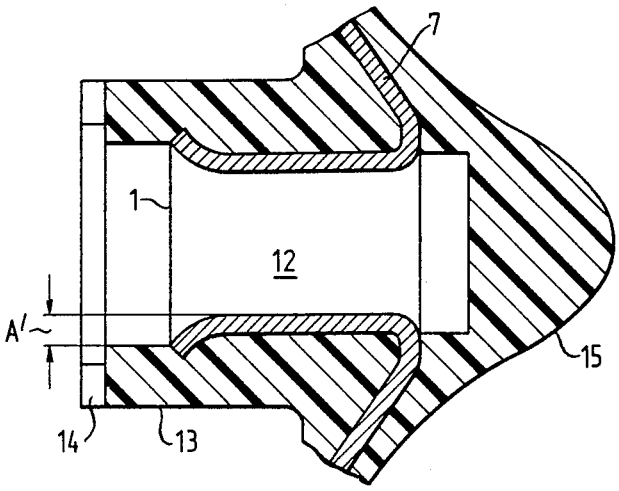

FIG. 4 Details of another embodiment of a water pump impeller in cross-section.

A first embodiment of a water pump impeller shown in FIGS. 1 and 2 comprises a boss 1 with which the water pump impeller is mounted on a not shown drive shaft. By means of a revolution paraboloid-like reinforcing region 2 is then connected to boss 1 a coaxially positioned, annular disk part 7 which is at right angles to the boss axis and on which are shaped guide vanes 3. Reinforcing region 2 is initially at an acute angle to boss 1. Reinforcing region 2 and disk part 7 together form a reinforcing disk 4, around either side of which is injection moulded plastic, whereas the plastic is only applied to the outer surface 5 of the boss, so that the water pump impeller with the inner metal face of boss 1 can be mounted on the drive shaft. For better anchoring of the plastic with the reinforcing disk 4, bores 6 are distributed over the surface of reinforcing disk 4. These bores 6 can cover roughly 40 to 70% of the surface. The boss 1 of reinforcing disk 4 also extends over at least 40% of the boss length. The disk part 7 is approximately 2 to 4 mm smaller than the diameter D corresponding to the outer circumference 8 of the water pump impeller. The side of the impeller remote from the guide vanes 3 is aligned in the present case with the free end face of the boss 1. Reinforcing disk 4 passes up to the outer edge of the water pump impeller, i.e. it completely supports the guide vanes 3, which are made from plastic on the concave side of the reinforcing disk. Radial plastic ribs 11 are shaped between boss 1 and reinforcing region 2.

There are several possible embodiments for the construction of boss 1, which in the present case is constructed in one piece with the reinforcing disk 4. For example, boss 1 and reinforcing disk 4 can be made in one piece from a deep-drawn steel sheet.

Differing from the present exemplified embodiment, it is possible to form boss 1 and disk part 7 from two parts which can be joined together. Boss 1 can be made from a thick material, e.g. a tubular steel cylinder with a thickness of 4 mm and the disk part 7 can be made from a thin material of e.g. 0.75 mm. The material of boss 1 and that of disk part 7 can also have different strength characteristics. Boss 1 and disk part 7 can be joined to one another by welding, shrinking or compressing. It is also possible to construct boss 1 in such a way that it extends over the entire length of the water pump impeller.

In the embodiment shown in FIG. 3 a metal reinforcing sleeve 9 is additionally pressed over the cylindrical boss part and assists the boss against cold flow. In FIG. 3 reinforcing sleeve 9 is completely embedded in plastic. Reinforcing sleeve 9 can also be referred to as the boss ring.

It can be gathered from the purely diagrammatic representations of FIGS. 1 and 3 that the plastic part of the water pump impeller is aligned with the boss 1 on one end face of the latter and that at the other end the plastic is formed in the boss axis direction over and beyond the metal boss 1. In this region the plastic ends at a given distance A from the boss inner face to ensure that the plastic does not come into frictional contact with the drive shaft. For embedding reinforcing disk 4 and boss 1 an abrasion-resistant, stable plastic is provided and which on either side has a wall thickness of in each case 1 to 2 mm, at least on the reinforcing disk 4. In the gap between the reinforcing region 2 and boss 1 radial, plastic reinforcing rings 11 are provided in the present embodiment.

FIG. 4 illustrates that the free end 12 of boss 1 is widened in trumpet-shaped manner. On placing the boss on the drive shaft, this widening acts as a funnel, so that the mounting of the boss 1 on the drive shaft is facilitated. It can be seen that the free end 12 of boss 1 terminates in a plastic part 13 set back from the inner surface of boss 1 by distance A'. In the presently represented embodiment, plastic part 13 is cylindrical. A gasket 14, which is purely diagrammatically shown, is placed on its free end face.

In the case of FIG. 4 boss 1 is closed on one side by an outwardly streamlined plastic part 15, which on the one hand has the function of reinforcing disk part 7 and on the other prevents eddies in the liquid upstream of the centre of the impeller. Plastic part 15 is rotationally symmetrical to the boss axis. It tapers as from the shoulder of reinforcing disk 4 and in the present embodiment is in the form of a paraboloid of revolution.

I claim:

1. Water pump impeller for use in a cooling water pump for an internal combustion engine comprising a metal boss with a radially inner surface for mounting on a shaft and a radially outer surface, an annular reinforcing sleeve fitting tightly around said radially outer surface of the metal boss, a metal reinforcing disk coaxially and integrally shaped on and extending from one end face of said boss, plastic encasing said boss, said reinforcing sleeve and said disk, impeller blades composed of plastic projecting from the plastic encasing said boss, said reinforcing sleeve and said disk in an outer circumferential region of the water pump impeller, said plastic extending longitudinally over and beyond said one end face of said boss, said reinforcing disk extending radially to the vicinity of said impeller blades and defining in the vicinity of said impeller blades an annular disk part, said disk between said boss and said annular disk part having a revolution paraboloid-like reinforcing region lying at an acute angle to said boss with the concave side of the paraboloid-like reinforcing region adjacent said one end face of said boss said impeller blades being placed on the concave side of said reinforcing disk and said plastic projecting over and beyond said one end face of the boss and terminating at a given radial spacing from the radially inner surface of the boss to avoid contact with the shaft on which the metal boss is mounted.

2. Water pump impeller according to claim 1 wherein said reinforcing sleeve is completely embedded in plastic.

3. Water pump impeller according to claim 1 wherein radial ribs composed of plastic project from the plastic encasing said boss, said reinforcing sleeve and said disk and extend between said metal boss and the reinforcing region.

* * * * *